United States Patent [19]

Nilson

[11] 4,146,182

[45] Mar. 27, 1979

[54] SPRAYING DEVICE

[75] Inventor: Billy N. Nilson, Mjölby, Sweden

[73] Assignee: KeNova AB, Mjölby, Sweden

[21] Appl. No.: 805,443

[22] Filed: Jun. 10, 1977

[30] Foreign Application Priority Data

Jun. 10, 1976 [SE] Sweden ..... 7606602

[51] Int. Cl.[2] ..... B05B 11/04

[52] U.S. Cl. ..... 239/323; 239/327; 239/356; 239/533.13

[58] Field of Search ..... 239/533.13, 533.14, 239/308, 323, 327, 356; 222/209, 213, 215

[56] References Cited

U.S. PATENT DOCUMENTS

| | | | |
|---|---|---|---|
| 2,655,407 | 10/1953 | Ingell | 239/356 X |
| 3,206,079 | 9/1965 | Mancusi, Jr. | 222/213 |
| 3,545,682 | 12/1970 | Beard | 239/533.13 |
| 3,794,247 | 2/1974 | Corsette | 239/327 |
| 4,020,978 | 5/1977 | Szczepanski | 222/209 |

*Primary Examiner*—John J. Love

*Attorney, Agent, or Firm*—Finnegan, Henderson, Farabow & Garrett

[57] ABSTRACT

A double-walled spraying device having an air space in an outer container formed between resilient side walls, the inner side wall forming an inner container holding a fluid to be sprayed, and an outer container holding air. The top of the device is also double-walled, the inner top wall being substantially rigid and the outer top wall including an annular diaphragm which is conically convex in the normally closed position of the diaphragm. The space between the two top walls comprises a mixing chamber accessible to the fluid in the inner container and to air under manual pressure from the outer container to form a spray through a perforated dome.

8 Claims, 3 Drawing Figures

SPRAYING DEVICE

This invention refers to a spraying device.

One object of the invention is to provide a spray bottle or the like, which may be manufactured at low costs and yet gives an efficient spraying action.

To accomplish this and other objects, the spraying device has the characteristics defined in the claims.

Figure 1:
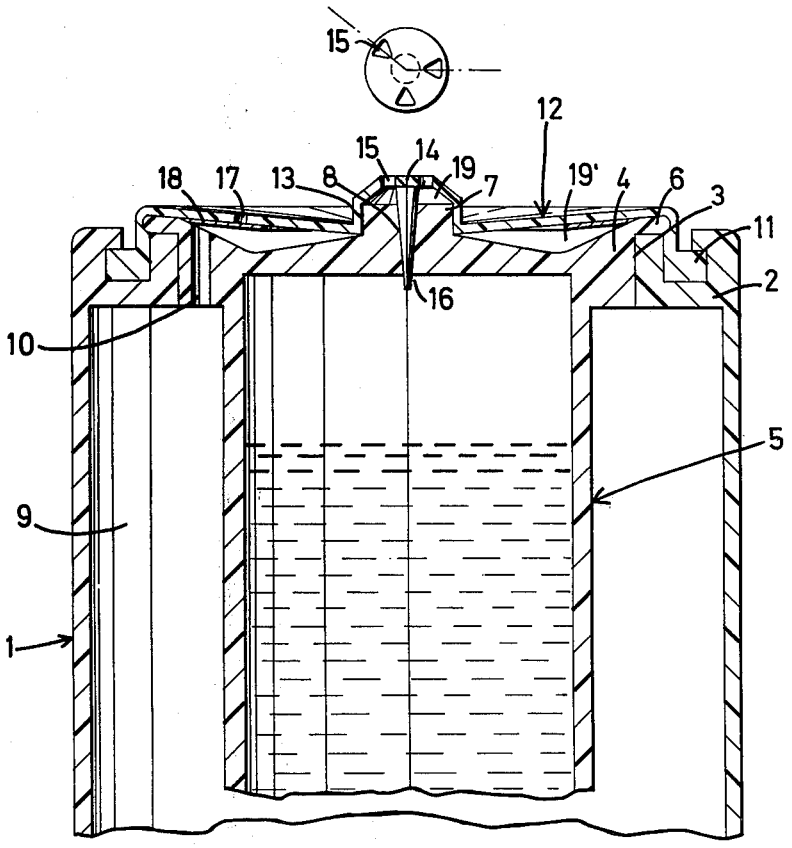

In the accompanying drawings, an exemplifying embodiment of the invention is shown and FIG. 1 illustrates a section through an upper portion of a container provided with the new spraying device and with the parts in an initial rest position.

Figure 2:
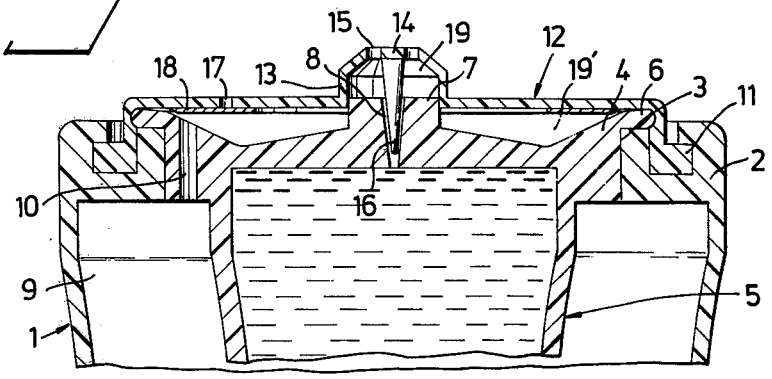
Figure 3:
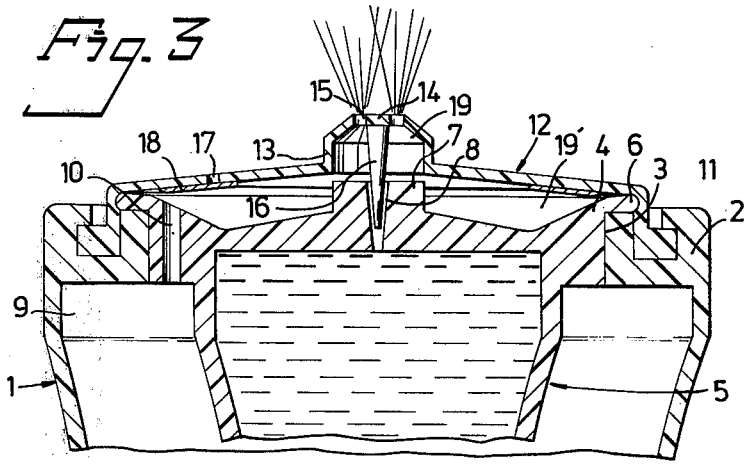

FIG. 2 is a view similar to FIG. 1 but with the parts in an intermediate position in which a pressure has been built up in the device, and FIG. 3 is a similar view but with the parts in active (spraying) position.

The spraying device as illustrated comprises an outer container 1 preferably made from a plastic material having resiliently flexible properties, so that the container may be manually squeezed and thereafter tends, by virtue of the resiliency thereof, to return to its initial shape. This container has side walls, a bottom wall, not shown, and an upper wall 2, provided with an opening 3. Except for the opening 3 the container is closed, A portion 4 of the upper wall of an inner container 5 is sealingly disposed in the opening 3, and said inner container, similarly to the outer container preferably is made from a plastic material having elastically yieldable properties and has side walls and bottom wall and is closed except for an opening 8 to be described. The upper portion of the inner container engages the upper surface of the wall 2 by means of a circumferential flange 6. The upper wall of the inner container defines, in the central portion thereof, an upwardly directed cylindrical or annular element 7 and has a central preferably conical opening 8 for a purpose to be later explained. A space 9 is defined between the outer and the inner containers. Said space will in the following description be referred to as a buffering space. Said buffering space, which also serves as an air container, communicates with a mixing chamber 19, to be later described, by means of a passage 10, which of course can consist of a plurality of holes.

The wall 2 is provided with a portion to securely hold a foot portion 11 of a resiliently flexible diaphragm 12, which normally, as may be seen in the drawing inclines downwardly and inwardly so that in this position it is inwardly curving. The central portion of the diaphragm is shaped as a sleeve 13, the upper end being closed by means of a wall 14 in the top portion thereof. However, a number of minutely dimensioned openings 15 are provided in this wall and a conical pin 16 projects downwardly from the central portion of the wall 14. Said pin 16 (FIG. 1) is in the illustrated position of the diaphragm intended to sealingly engage the conical opening 8 in order to close the same. Further one or more venting openings 17 are provided in the diaphragm 12, and said normally kept closed by means of a resilient ring 18 acting against the inner side of the diaphragm. The outer portion of said ring 18 is fixed between the diaphragm 12 and the flange 6 and the inner portion thereof obviously serves a flap valve.

As will be seen in the drawing space will be defined between the upper wall of the inner container and the diaphragm 12. This space will be referred to as a mixing chamber and has reference number 19. The sleeve shaped part 13 sealingly surrounds the portion 7 in the shown initial position of the operating elements of the spraying device and thereby, it is understood, that the outer portion 19' of the mixing chamber 19 in the shown position will be separated from the central space within the sleeve shaped part 13. It is also evident that the portion 19' in contrast to the central portion of the mixing chamber 19 normally is sealed from the surrounding atmosphere.

When using the device, a pressure is exerted upon the container 1 by means of the hand. By the action of this pressure, the actual container will be deformed and the inner container 5, due to the pressure exerted upon the air in the buffering space 9, in the passage 10 and in the mixing chamber 19, will be subjected to a pressure and since the inner container similarly to the outer container has an elastically yieldable wall, a squeezing of the inner container will take place, whereby a pressure will be exerted upon the liquid contained in the inner container 5. However, the manually exerted pressure also acts, by means of the compressed air, through the passage 10 upon the diaphragm 12, which will first be straightened and finally merges into a slightly outwardly bent shape. In the first part of said deforming of the diaphragm, the pin 16 will leave the sealing engagement with the conical opening 8 as will be seen in FIG. 2 but the communication between the inside 19 of the sleeve 13 and the space 19' is still not established by action of the sealing engagement between the inside of the sleeve 13 and the portion 7. The air in the buffering space 9, in the passage 10 as well as in the space 19', is thereby compressed when liquid has begun to be squeezed out to the inner portion of the sleeve 13. When the diaphragm 12 as will be seen in FIG. 3 is deformed to such an extent that the sealing engagement between the sleeve shaped portion 13 and the portion 7 ceases, the compressed air will, however, meet the outwardly pressed liquid in the mixing chamber and as a result hereof, a rapid and efficient mixing of air and liquid is a obtained and the resulting mixture leaves the mixing chamber at a high speed through the openings 15 as a spray.

When the pressure exerted upon the outer container 1 is released, this container as well as the diaphragm and the inner container tend to return to the original shapes and positions thereof. The rapid closing of the lower opening of the sleeve 13 would, however, make impossible such entering of air into the space 9 that the outer sleeve could return to the original shape thereof and said outer sleeve should thereby be successively squeezed together for each time of use. In order to prevent this, the venting opening 17 is provided. Consequently, by means of the sub-pressure resulting when the portions tend to return to their original positions and shapes, the ring 18 will leave the position closing the venting opening and air may be sucked into the space 9.

Since the pin 16 successively opens while the air pressure outside the mixing chamber defined by the inner of the sleeve 13 is permitted to build up, a very efficient mixing of the two media is obtained and, as may be seen in the drawing, the structure is so simple that the spraying device may be manufactured at low costs in long series.

What is claimed is:

1. A spraying device comprising an outer sealed container which by means of one or more passages communicates with a mixing chamber, a sealed, inner container provided to hold a quantity of fluid and positioned within said outer container and so dimensioned that buffering space is defined between the two containers, said inner container having at least one outlet passage by means of which said inner container communicates with the mixing chamber, a flexible and resilient diaphragm normally preventing communication between said buffering space and the open air via said mixing chamber, said diaphragm being further connected to a closure element sealing the outlet passage of the inner container in the normal idle position of the diaphragm, narrow outlet openings leading from the mixing chamber to the open air, the containers having elastically deformable walls so that a pressure of a certain degree exerted upon the outer container compresses the air enclosed in the buffering space and thereby also compresses the inner container and as a result hereof generates a pressure upon the fluid enclosed in the inner container, the deformation of the diaphragm also causing the closure element connected thereto to leave the sealing engagement with the outlet passage of the inner container, thereby enabling the air subjected to pressure to leave the mixing chamber through the outlet openings thereof together with a small amount of liquid from the inner container while forming a spray.

2. A device according to claim 1, characterized in that the mixing chamber has a central portion which, in the normal idle position of the diaphragm, is isolated from the rest of the mixing chamber by means of mutually sealing separating portions connected respectively to the diaphragm and to one wall of the mixing chamber, the outlet passage of the inner container opening into said central portion, while the passage of the outer container communicates with the portion of the mixing chamber which is separated from said central portion, and that said separating portions are so shaped, that they are brought out of sealing engagment with each other when said diaphragm has been straightened out to a substantially planer position from a normal and inwardly curving original position.

3. A device according to claim 1, characterized in that at least one vent opening is provided in the part of the mixing chamber which is normally held separated from the central portion of the mixing chamber, said opening normally being sealed by a valve means, which is meant to open by a sub-pressure in the first mentioned part of the mixing chamber.

4. A device according to claim 1, characterized in that the closure element and the outlet passage of the inner container are conically shaped.

5. A device according to claim 1, characterized in that the central portion of the diaphragm is shaped as a sleeve having an end wall.

6. A device according to claim 3, characterized in that the valve means comprises a resilient ring.

7. A device according to claim 2, characterized in that at least one vent opening is provided in the part of the mixing chamber which is normally held separated from the central portion of the mixing chamber, said opening normally being sealed by a valve means, which is meant to open by a sub-pressure in the first mentioned part of the mixing chamber.

8. A device according to claim 2, characterized in that the central portion of the diaphragm is shaped as a sleeve having an end wall.

* * * * *